US005797500A

United States Patent [19]

Lacoste

[11] Patent Number: 5,797,500

[45] Date of Patent: Aug. 25, 1998

[54] GUN RACK APPARATUS

[76] Inventor: Marvin Lacoste, P.O. Box 292, Kiln, Miss. 39556

[21] Appl. No.: 715,761

[22] Filed: Sep. 19, 1996

[51] Int. Cl.[6] ..... A47F 7/00

[52] U.S. Cl. ..... 211/64

[58] Field of Search ..... 211/64, 87, 89, 211/181, 70.5, 70.2; 248/315; 42/94

[56] References Cited

U.S. PATENT DOCUMENTS

| | | | |
|---|---|---|---|
| 554,252 | 2/1896 | Falk | 211/64 |
| 795,566 | 7/1905 | Wallace | 211/64 |
| 945,520 | 1/1910 | Greenwood | 211/64 X |
| 2,783,896 | 3/1957 | Agostini et al. | 211/64 |
| 3,007,581 | 11/1961 | Moore | 211/64 |
| 3,022,898 | 2/1962 | Loeb | 211/64 |
| 3,286,967 | 11/1966 | Ferrell | 248/201 |
| 3,294,247 | 12/1966 | Norrington | 211/64 |
| 3,477,586 | 11/1969 | Haluska | 211/64 |
| 3,876,078 | 4/1975 | Gomes et al. | 211/64 |
| 4,139,100 | 2/1979 | Reed | 211/4 |
| 4,144,971 | 3/1979 | Balibrea | 211/64 |
| 4,197,951 | 4/1980 | Shassere | 211/64 |
| 5,203,462 | 4/1993 | Brooks | 211/87 X |
| 5,263,592 | 11/1993 | Dingee, Jr. | 211/64 |

FOREIGN PATENT DOCUMENTS

| | | | |
|---|---|---|---|
| 2170994 | 8/1986 | United Kingdom | 211/64 |

*Primary Examiner*—Jose V. Chen
*Attorney, Agent, or Firm*—Pravel, Hewitt & Kimball

[57] ABSTRACT

An improved gun rack having a unitary body including a vertical upright base portion, which could be secured to a door or the like structure, a first upper arcuate arm, extending outward and away from the base portion, for securing the upper portion or barrel of the gun, and a lower horizontal foot member extending outward from the base portion upon which the trigger housing would be secured so that the trigger housing, when engaged by the foot member would allow the rifle to lean into the arcuate arm and be secured therein. The improved gun rack would be positioned vertically on a door, and would not extend outward from the door more than the relative thickness of the weapon itself, as the weapon was held upright within the rack. There may be further included a cushion on the arcuate end lower arms so that the metallic surfaces of the gun would not be tarnished when making contact with the gun rack.

12 Claims, 1 Drawing Sheet

GUN RACK APPARATUS

BACKGROUND OF THE INVENTION

1. Field of the Invention

The apparatus of the present invention relates to gun racks. More particularly, the present invention relates to an improved gun rack for accommodating a rifle or similar type weapon within a confined space supported by the gun rack.

2. General Background

In the construction of gun racks, the construction varies from the cabinet type racks which accommodate a plurality of weapons such as shot guns or rifles upright within a confined cabinet having doors for ingress and egress from the cabinet. Other types of gun racks may include racks that accommodate a weapon in a horizontal position along a wall or other types of locations, so as to make the weapon readily accessible. However, one of the shortcomings in the storing or the securing of weapons such as rifles, is that they generally must be stored in the manner that I discussed earlier, in view of the fact that because of their length they can usually not be stored, for example, on the back of a door to a room or a door to a closet, and must be stored along a wall of sufficient length to accommodate their length or in the upright position within a cabinet. Therefore, there is a need in the art for a manner in which to secure a rifle or the like weapon, where it could be stored along a wall or within a confined area like on the back of an opened door or on a closet door so that it would be stored within a confined area than is normally done.

SUMMARY OF THE PRESENT INVENTION

The present invention solves the shortcomings in the art in a simple and straight forward manner. What is provided is an improved gun rack having a unitary body including a vertical upright base portion, which could be secured to a door or the like structure, a first upper arcuate arm, extending outward and away from the base portion, for securing the upper portion or stock of the gun, and a lower horizontal foot member extending outward from the base portion upon which the trigger housing would be secured so that the trigger housing, when engaged by the foot member would allow the rifle to be supported by the arcuate arm and be secured therein. The improved gun rack would be positioned vertically on a wall or door, and would not extend outward from the door more than the relative thickness of the weapon itself, as the weapon was held upright within the rack. There may be further included a cushion on the arcuate end lower arms so that the metallic surfaces of the gun would not be tarnished when making contact with the gun rack.

Therefore, it is a principal object of the present invention to provide an improved gun rack which could be secured onto a wall, closet door or the like, so that the gun could be stored upright in a manner that it would extend no more than substantially the thickness of the gun away from the door;

It is a further object of the present invention to provide an improved gun rack which is made of a unitary section of metal having an upper arcuate arm and a foot member, for accommodating the gun on the rack while the rack is secured to a vertical surface such as a wall;

It is a further objection of the present invention to provide a gun rack in which a gun may be stored on a wall, or within a confined space along the surface of a door, and can be easily placed in the rack or retrieved from the rack as the case may be.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
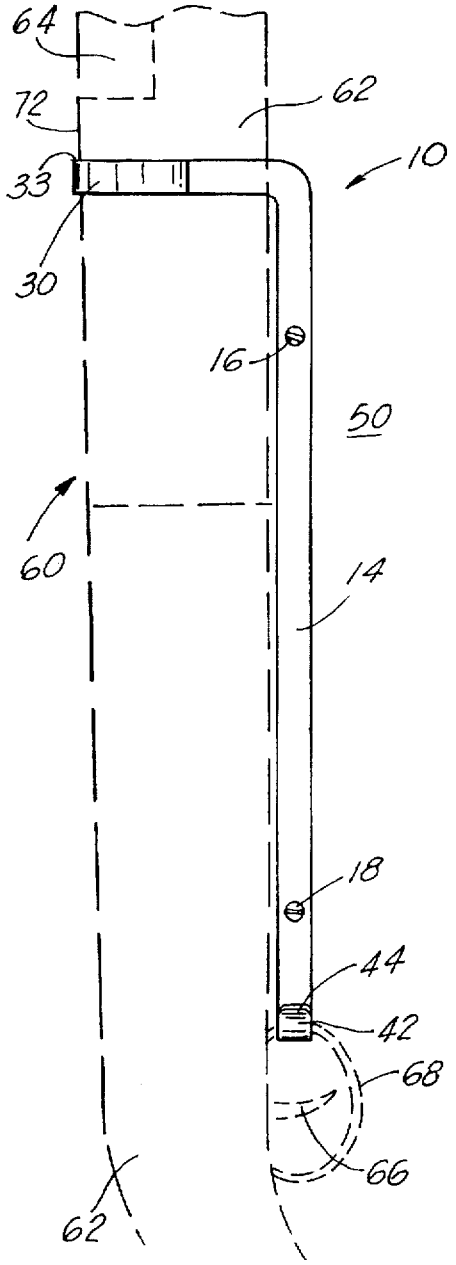
FIG. 1 illustrates an overall view of the gun rack of the present invention supporting a rifle or the like weapon therein.
Figure 2:
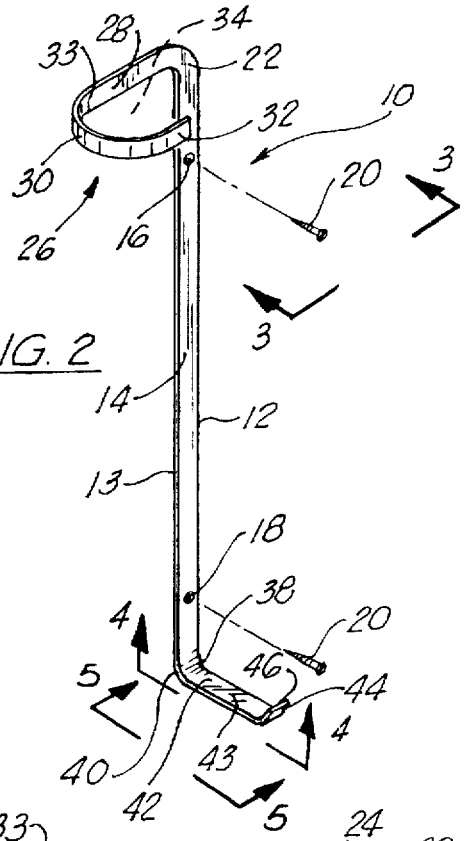
FIG. 2 is an overall view of the preferred embodiment of the present invention.
Figure 3:
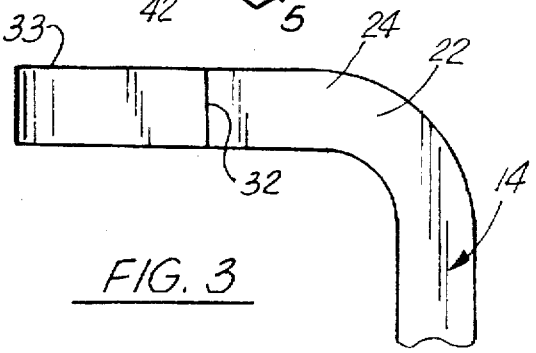
FIG. 3 is an isolated view of the upper arcuate arm portion of the present invention along lined 3—3 in FIG. 2.
Figure 5:
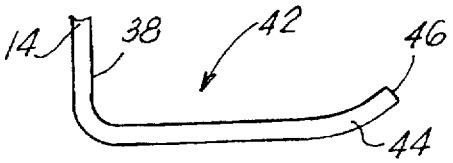
FIG. 5 is an isolated side view of the lower foot member of the gun rack of the present invention along lines 5—5 in FIG. 2.
Figure 4:
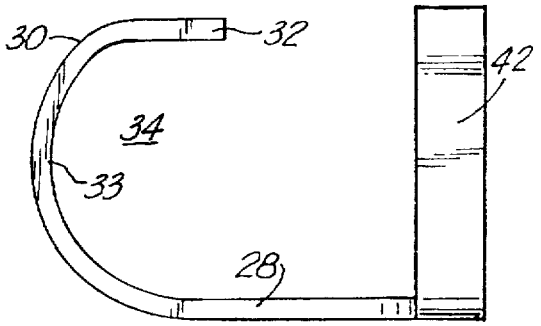
FIG. 4 is a top view of the gun rack of the present invention along lines 4—4 in FIG. 2.

FIGS. 1–5 illustrate the preferred embodiment of the apparatus of the present invention as illustrated in overall view in FIG. 2. Gun rack apparatus 10 as illustrated would include a unitary body 12, which would be constructed of a single piece of flat metal 13, the metal 13 which would be a single strip of metal approximately in the preferred embodiment one half inch wide, and extending through a vertical distance of approximately twelve to fourteen inches, the preferred length of which will be discussed further. Continuing to make reference to FIG. 2, body 12 would include a vertical main body portion 14 having a first bore 16 and a second bore 18, the bores 16 and 18 for accommodating screws 20 therethrough so that the improved gun rack 10 may be secured to a wall or the like surface, preferably in a vertical position. As noted, the upper end 22 of vertical body portion 14 would include a curved portion 24 which has been bent in a ninety degree angle, so that there is defined an arcuate arm member 26, a portion of which is a first portion 28 which extends along the face of the door, and a semicircular portion 30 extending therefrom terminating in an open end 32. The arcuate portion 26 would define an opening 34 through which the stock of a gun which would be positioned as seen in FIG. 1 and will be discussed further.

Turning now to the lower end of the rack, at the lower vertical point 38 of vertical body portion 14, there is seen a ninety degree bend 40 from which a horizontal foot member 42 is extending outward from flat body portion 14, a distance of approximately one to two inches, and which would result in a upper extending toe 44, terminating at 46.

As seen in FIG. 1, the improved gun rack has been secured to a surface 50 such as a wall, door or the like, through the screws 16, 18 with the body portion 14 of gun rack 10 being in the vertical position. As illustrated in FIG. 1, the gun rack is supporting in phantom view, a weapon 60 which may be any type of a weapon such as a rifle or a shotgun, having a stock portion 62 and an upper barrel portion 64 extending therefrom. This, of course, would be a typical type of weapon used in hunting. As illustrated in FIG. 1, the lowermost foot member 42 is extending outward from body portion 14 with the toe 44 extending outward therefrom. In FIG. 1 the weapon includes a trigger 66, surrounded by a housing 68. The housing 68, as illustrated is secured by the lower foot portion 42 of the gun rack 10, and is literally supported by foot member 42. When the weapon 60 is placed in this manner, the weapon, due to gravity, and the weight of the barrel 64, would remain in the vertical orientation, and the upper surface 72 of stock 62 would then rest against the inner surface 33 of arcuate member 30 as was previously described.

In this manner, as illustrated, the weapon 60 is secure within the rack 10, and while supported against the surface 50 such as a wall or door, occupies a space substantially the thickness of the weapon, or equal to the length of the lower foot 42, and the upper arcuate member 30, away from the door. Therefore, once the gun rack 10 is secure against the door 50 and the gun is placed therein, there is but two to three inches of space which is occupied by the weapon so that a door could be fully opened. Or, for example, a closet door may be closed, and the gun 60 hanging on the rack would not interfere with any clothes or the like within the closet. Further, although it may not be clearly illustrated, it is foreseen that because the gun rack would be made of a unitary piece of metal such as aluminum or the like, and would be bent in order to form the upper arcuate arm 26 and the lower foot member 42 as seen, because the weapon 60 is being supported on the metal parts of the weapon, i.e. the trigger housing 68 and the barrel 64, it is foreseen that the inner surface 33 of arcuate support member 30 and the upper surface 43 of lower foot member 42 may be coated with a non-scratch surface such as Teflon, rubber, plastic or the like, so that when a weapon is engaged in rack 10, there is no problem with scratching of the metal on the weapon by the metal gun rack.

The following table lists the part numbers and part descriptions as used herein and in the drawings attached hereto.

PARTS LIST

| Description | Part No. |
|---|---|
| gun rack apparatus | 10 |
| unitary body | 12 |
| flat metal | 13 |
| main body portion | 14 |
| first bore | 16 |
| second bore | 18 |
| screws | 20 |
| upper end | 22 |
| curved portion | 24 |
| arm member | 26 |
| first portion | 28 |
| arcuate member | 30 |
| open end | 32 |
| inner surface | 33 |
| opening | 34 |
| point | 38 |
| ninety degree bend | 40 |
| foot member | 42 |
| upper surface | 43 |
| upper extending toe | 44 |
| surface | 50 |
| weapon | 60 |
| stock portion | 62 |
| upper stock portion | 64 |
| trigger | 66 |
| trigger housing | 68 |
| surface | 72 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved support apparatus comprising:

a. a gun to be supported;

b. a principal frame mountable on an upright surface such as a wall, having a central body portion in a substantially vertical orientation, said central body portion further comprising:

i. an upper end and a lower end;

ii. a first continuous circulate support arm extending out from the upper end of the central body, and positioned off center from a center line of the vertical orientation of the central body portion and having a free end, said free extending back towards said center line;

iii. a foot member extending out from the lower end of the central body portion, for engaging a trigger housing of the gun to be supported so that the gun rests against the arcuate support arm of the frame portion, in a substantially vertical orientation in line with the orientation of said central body portion.

2. The apparatus in claim 1, wherein the principal frame portion would be comprised of a single piece of metal, such as aluminum.

3. The apparatus in claim 1, wherein the first arcuate support arm would extend out away from the central body sufficient distance to accommodate an upper portion of the gun.

4. The apparatus in claim 1, wherein the foot member would extend out a distance substantially equal to the distance of the arcuate support arm, and would terminate in an upper depending toe.

5. The apparatus in claim 1, wherein the principal frame portion may be secured to a wall or door with screws.

6. The apparatus in claim 1, wherein there would be further included a layer of cushioning material such as plastic, Teflon, or rubber at points where the gun makes contact with the gun support apparatus.

7. A support apparatus comprising:

a. a weapon to be supported in a vertical orientation on said apparatus;

b. a principal frame, mountable on an upright surface, such as a door or wall, and further comprising a central body portion in a vertical orientation;

further comprising:

c. a central body having an upper end and a lower end;

d. a first continuous arcuate support arm extending out from an upper end of the central body portion a sufficient distance to accommodate the upper portion of the weapon, so that the weapon is positioned in substantially the same vertical orientation as the central body portion and having a free end, said free end extending back towards said central body portion;

e. a foot member extending out from the lower end of the central body portion, for engaging a trigger housing of the weapon to be supported while an upper portion of the gun rests against the first arcuate support arm of the central body portion.

8. The apparatus in claim 7, wherein the principal frame portion would be comprised of a single piece of metal, such as aluminum.

9. The apparatus in claim 7, wherein the foot member would extend out a distance substantially equal to the distance of the arcuate support arm, and would terminate in an upper depending toe.

10. The apparatus in claim 7, wherein the principal frame portion would be secured to a wall of door with screws.

11. The apparatus in claim 7, wherein there would be further included a layer of cushioning material such as plastic, Teflon, or rubber at points where the gun makes contact with the gun support apparatus.

12. A support apparatus, comprising:

a. a weapon to be supported in a vertical orientation on said apparatus;

b. a principal frame mountable on an upright surface, such as a door, said principal frame further comprising:

c. a central body portion in a vertical orientation, said central body portion having an upper and lower end, the upper and lower ends in vertical alignment;

d. a foot member extending out from the lower end of the central body portion, for supportedly engaging a trigger housing of the weapon; and e. a continuous, acuate support arm extending out from the upper end of and positioned off center from a center line of the vertical orientation of the central body portion a sufficient distance to support an upper portion of the weapon and having a free end, said free end extending back towards said center line so that the weapon, while supported, is in a substantially vertical orientation with the central body portion.

* * * * *